US006652597B1

(12) United States Patent
Negele et al.

(10) Patent No.: US 6,652,597 B1
(45) Date of Patent: Nov. 25, 2003

(54) N-VINYL-CONTAINING POLYMERIC TANNING MATERIALS

(75) Inventors: Anton Negele, Deidesheim (DE); Gerhard Wolf, Ketsch (DE); Axel Kistenmacher, Bad Dürkheim (DE); Georg Igl, Weissach (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/646,898

(22) PCT Filed: Mar. 29, 1999

(86) PCT No.: PCT/EP99/02147

§ 371 (c)(1),
(2), (4) Date: Oct. 10, 2000

(87) PCT Pub. No.: WO99/53104

PCT Pub. Date: Oct. 21, 1999

(51) Int. Cl.[7] ..... C14C 1/00; D01C 3/00
(52) U.S. Cl. ..... 8/94.19; 8/94.1 R; 8/94.21; 8/94.1 P
(58) Field of Search ..... 8/94.1 R, 94.19, 8/94.21, 94.1 P

(56) References Cited

U.S. PATENT DOCUMENTS

| | | | | |
|---|---|---|---|---|
| 2,205,882 A | | 6/1940 | Graves | 149/5 |
| 2,205,883 A | | 6/1940 | Graves | 149/5 |
| 4,518,475 A | | 5/1985 | Sivilotti | 204/247 |
| 4,743,666 A | * | 5/1988 | Engelhardt et al. | 526/240 |
| 5,425,784 A | * | 6/1995 | Denzinger et al. | 8/94.33 |

FOREIGN PATENT DOCUMENTS

| | | |
|---|---|---|
| DE | 32 48 019 | 6/1984 |
| DE | 32 48 031 | 6/1984 |

* cited by examiner

*Primary Examiner*—Yogendra N. Gupta
*Assistant Examiner*—Preeti Kumar
(74) *Attorney, Agent, or Firm*—Oblon, Spivak, McClelland, Maier & Neustadt, P.C.

(57) ABSTRACT

N-Vinyl-containing polymers obtainable by free-radically initiated polymerization of a monomer or monomer mixture of (A) from 5 to 100% by weight of an N-vinylamide or N-vinylamine, (B) from 0 to 95% by weight of monoethylenically unsaturated carboxylic acids having from 3 to 8 carbon atoms or their derivatives, (C) from 0 to 95% by weight of other N-vinyl and/or C-vinyl compounds and (D) from 0 to less than 10% by weight of other copolymerizable monomers, are useful in the form of aqueous solutions or dispersions as tanning materials for self-tanning, pretanning and cotanning of leather pelts and fur pelts and for retanning leather and fur.

10 Claims, No Drawings

N-VINYL-CONTAINING POLYMERIC TANNING MATERIALS

The present invention relates to the use of N-vinyl-containing polymers of N-vinylamides and/or N-vinylamines and optionally monoethylenically unsaturated carboxylic acids or their derivatives, other N-vinyl and/or C-vinyl compounds and also other copolymerizable monomers in the form of aqueous solutions or dispersions as leather and fur tanning materials.

In the making of leather, the hide is customarily tanned with mineral tanning materials such as basic chromium, aluminum and/or zirconium salts alone or combined with synthetic tanning materials. A subsequent retanning with natural or synthetic tanning materials mainly has the purpose of improving leather properties such as hand, softness, grain constitution and fullness.

Examples of retanning materials used are syntans, i.e., water-soluble condensation products of, for example, naphthalenesulfonic acid and formaldehyde or of phenolsulfonic acid, formaldehyde and urea, also ligninsulfonic acids and polymers and copolymers based on acrylic acid and other unsaturated polymerizable carboxylic acids, generally combined with the aforementioned syntans.

For instance, U.S. Pat. Nos. 2,205,882 and 2,205,883 describe the use of polyacrylic acid, of copolymers of acrylic acid and methacrylic acid, of styrene-maleic anhydride copolymers, of polymethacrylic acid and of copolymers of methacrylic acid with styrene or methyl methacrylate for tanning leather. The disadvantage with these products is that they frequently fail to produce the desired fullness and grain fineness. In addition, the use of such compounds is frequently associated with tendencies toward a loose grain or double skin, especially in the relatively loosely structured parts of the hide. Moreover, these products generally tend to lighten the dyeing considerably, which necessitates increased consumption of dye and hence more costly formulation.

DE-A 32 45 541, DE-A 32 48 019 and DE-A 32 48 031 disclose copolymers of vinylphosphonic esters, unsaturated sulfonic esters, the total amount of these two monomers being not less than 10% by weight, acrylamide and optionally up to 30% by weight of further monomers such as N-vinylamides and/or unsaturated monocarboxylic acids. The copolymers are recommended for use as retanning materials, inter alia.

Copolymers of N-vinylcarboxamides and their monoethylenically unsaturated compounds such as acrylic acid, acrylic esters, vinyl acetate, N-vinylpyrrolidone or acrylonitrile are well-known products, as are the modified copolymers obtainable by the action of acids or bases, wherein the carboxamide groups can be wholly or partly eliminated from the cocondensed N-vinylcarboxamides and wherein the cocondensed comonomers may be hydrolyzed. Such partially or completely hydrolyzed copolymers of N-vinylformamide are used, for example, as paper dry and wet strength enhancers, as fixing agents and as diketene sizing promoters.

Existing polymeric retanning materials for leather are still in need of improvement with regard to the fullness, grain fineness and grain tightness they confer on the leather and also with regard to the dyeing characteristics.

It is an object of the present invention to provide such retanning materials having improved properties.

We have found that this object is achieved by the use of N-vinyl-containing polymers obtainable by free-radically initiated polymerization of a monomer or monomer mixture of (A) from 5 to 100% by weight of an N-vinylamide of the general formula I

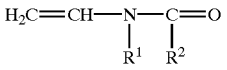

(I)

and/or of an N-vinylamine of the general formula II

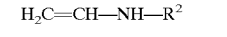

(II)

where $R^1$ and $R^2$ are independently hydrogen or $C_1$–$C_6$-alkyl, (B) from 0 to 95% by weight of monoethylenically unsaturated carboxylic acids having from 3 to 8 carbon atoms, their alkali metal, alkaline earth metal or ammonium salts, anhydrides, esters, amides and/or nitriles, (C) from 0 to 95% by weight of other N-vinyl and/or C-vinyl compounds selected from the group consisting of N-vinylpyrrolidone, N-vinylcaprolactam, N-vinylimidazole, N-vinyl-2-methylimidazole, N-vinyl-4-methylimidazole, N,N-diallylammonium chloride, vinyl acetate, vinyl propionate, styrene and methylstyrenes, and (D) from 0 to less than 10% by weight of other copolymerizable monomers, wherein the proportions of said monomers (A) to (D) add up to 100% by weight and the N-acyl groups derived from said N-vinylamides I are partially or completely removable from the resulting polymers by hydrolytic detachment using acids or bases, in the form of aqueous solutions or dispersions as tanning materials for self-tanning, pretanning and cotanning leather pelts and fur pelts and for retanning leather and fur.

Examples of useful monomers (A) of the formula I are N-vinylformamide, N-vinyl-N-methylformamide, N-vinylacetamide, N-vinyl-N-methylacetamide, N-vinyl-N-ethylacetamide, N-vinylpropionamide, N-vinyl-N-methylpropionamide and N-vinyl-butyramide. Of this group of monomers, N-vinylformamide is preferred.

Examples of useful monomers (A) of the formula II are the corresponding vinylamines (H instead of $R^1$) having the same $R^2$.

Useful monomers (B) are monoethylenically unsaturated carboxylic acids having from 3 to 8 carbon atoms, especially having from 3 to 6 carbon atoms, such as acrylic acid, methacrylic acid, dimethacrylic acid, ethacrylic acid, maleic acid, citraconic acid, methylenemalonic acid, allylacetic acid, vinylacetic acid, crotonic acid, fumaric acid, mesaconic acid and itaconic acid. The monoethylenically unsaturated carboxylic acids can be used in the copolymerization in the form of their free acid and the anhydride (if it exists) or in partially or completely neutralized form. To neutralize these monomers, preference is given to using alkali metal or alkaline earth metal bases, ammonia or amines, e.g., sodium hydroxide, potassium hydroxide, sodium carbonate, potassium carbonate, sodium bicarbonate, magnesium oxide, calcium hydroxide, calcium oxide, gaseous or aqueous ammonia, triethylamine, ethanolamine, diethanolamine, triethanolamine, morpholine, diethylenetriamine or tetraethylenepentamine.

Examples of further useful monomers (B) are the esters, amides and nitriles of the above-specified carboxylic acids, e.g., methyl acrylate, ethyl acrylate, methyl methacrylate, ethyl methacrylate, hydroxyethyl acrylate, hydroxypropyl acrylate, hydroxybutyl acrylate, hydroxyethyl methacrylate, hydroxypropyl methacrylate, hydroxyisobutyl acrylate, hydroxyisobutyl methacrylate, methyl hydrogen maleate, dimethyl maleate, ethyl hydrogen maleate, diethyl maleate, 2-ethylhexyl acrylate, 2-ethylhexyl methacrylate, acrylamide, methacrylamide, N-dimethylacrylamide, N-tert-butylacrylamide, acrylonitrile, methacrylonitrile, dimethylaminoethyl acrylate, diethylaminoethyl acrylate, diethylaminoethyl methacrylate and also the salts of the last monomers with carboxylic acids or mineral acids and also the quaternized products.

In a preferred embodiment, monomers (B) are selected from acrylic acid, methacrylic acid, maleic acid, maleic anhydride or mixtures thereof.

With regard to monomers (C), preference is given to styrene and methylstyrenes, i.e., α-methylstyrene, β-methylstyrene, o-methylstyrene, m-methylstyrene and p-methylstyrene.

Examples of other copolymerizable monomers (D) are acrylamidoglycolic acid, vinylsulfonic acid, allylsulfonic acid, methallylsulfonic acid, styrenesulfonic acid, 3-sulfopropyl acrylate, 3-sulfopropyl methacrylate and acrylamidomethyl-propanesulfonic acid and also monomers containing phosphonic acid groups, such as vinylphosphonic acid, allylphosphonic acid and acrylamidomethanepropane-phosphonic acid.

It will be appreciated that, for each of the four monomer varieties (A) to (D), it is also possible to use mixtures of the respective monomers.

Furthermore, the polymers set forth in the claims also encompass graft copolymers of the above-described N-vinyl-containing homo- or copolymers as grafting base with, for example, styrene and/or methylstyrenes, acrylonitrile, n-butyl acrylate, n-butyl methacrylate or other monomers already mentioned above. It will be readily appreciated that it is also possible to use mixtures of all the monomers already mentioned for grafting the N-vinyl-containing polymers.

Monomers (A) are preferably used in an amount of from 5 to 95% by weight, especially from 10 to 70% by weight, in particular from 20 to 60% by weight.

Monomers (B) are preferably used in an amount of from 5 to 95% by weight, especially from 10 to 90% by weight, in particular from 25 to 75% by weight.

Monomers (C) are preferably used in an amount of from 0 to 50% by weight, especially from 1 to 50% by weight.

Monomers (D) are preferably used in an amount of from 0 to 9% by weight, especially from 0 to 5% by weight, in particular from 0.1 to 5% by weight.

A preferred embodiment comprises using a monomer mixture from 10 to 70% by weight of monomers (A), from 10 to 90% by weight of monomers (B), from 0 to 50% by weight of monomers (C) and from 0 to 5% by weight of monomers (D).

The polymers described are prepared in a conventional manner, for example by solution, precipitation, suspension or emulsion polymerization, using compounds which form free radicals.

The polymerization temperatures are customarily within the range from 30 to 200° C., preferably within the range from 40 to 110° C. The polymerization takes place in the presence of polymerization initiators which form free radicals under the proposed polymerization conditions. Suitable initiators include, for example, hydrogen peroxide, peroxides, hydroperoxides, redox catalysts and especially nonoxidizing initiators, such as azo compounds which decompose in the free radicals, such as 2,2'-azobis(2-amidinopropane)dihydrochloride, 2,2'-azobis(N,N-dimethyleneisobutyramidine)dihydrochloride, 2,2'-azobis (2,4-dimethylvaleronitrile), 2,2'-azobis[2-methyl-N-(2-hydroxyethyl)propionamide] or 2,2'-azobisisobutyronitrile. It will be appreciated that it is also possible to use mixtures of different initiators. The amount of initiator used for the free-radical polymerization is within the range from 0.001 to 5% by weight, based on total monomers.

If polymers having low molecular weights are desired, it is possible, for example, to increase the initiator quantities customarily used in the polymerization, so that they are outside the range specified above for the initiator quantity. Low molecular weight copolymers can also be obtained by polymerizing in the presence of polymerization regulators or by employing polymerization regulators and higher amounts of initiator than will usually be necessary. Suitable polymerization regulators can be added in amounts of from 0.05 to 20% by weight, based on total monomers, and include, for example, formic acid, dodecyl mercaptan, thioglycolic acid, thioacetic acid and mercaptoalcohols, such as mercaptoethanol, mercaptopropanols and mercaptobutanols.

The polymers described have K values at not less than 7, preferably within the range from 10 to 250, especially within the range from 20 to 100. However, the polymers can also have K values up to 300. K values are determined by the method of H. Fikentscher, Cellulose-Chemie, Volume 13, pages 58 to 64 and 71 to 74 (1932), in aqueous solution at 25° C. at concentrations which, depending on the K value range, are within the range from 0.1% by weight to 5% by weight.

The polymers described yield on partial or complete elimination of the formyl groups or of the $C_1$–$C_6$-alkyl-C═O groups from the N-vinylamides I cocondensed in the polymer, to form amine or ammonium groups, hydrolyzed homo- or copolymers containing units of the formula Ia and/or IIa:

(Ia)

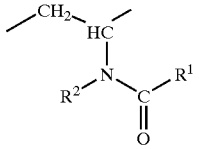

(IIa)

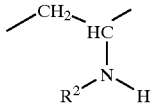

where $R^1$ and $R^2$ are each as defined above. Depending on the reaction conditions under which the hydrolysis is carried out, the hydrolysis of said units Ia is either partial (for example with degrees of hydrolysis ranging from 3 to 98%, especially from 30 to 90%) or complete. If copolymers of N-vinylamides I are used, the comonomers used can likewise be chemically modified, depending on the hydrolysis regime chosen, so that, for example, vinyl acetate units are converted into vinyl alcohol units, methyl acrylate units into acrylic acid units and acrylonitriile units into acrylamide or acrylic acid units.

The units of the formula IIa can thus be formed either through use of N-vinylamines II as monomers (A) or through the described hydrolysis of the units of the formula Ia which originate in the N-vinylamide monomers I.

Useful hydrolyzing agents are mineral acids, for example hydrogen halides, which can be used in gas form or in aqueous solution. Preference is given to using hydrochloric acid, sulfuric acid, nitric acid or phosphoric acid and also organic acids, for example $C_1$–$C_5$ carboxylic acids and aliphatic or aromatic sulfonic acids. The amount of acid required per acyl group equivalent to be eliminated from the cocondensed units Ia is within the range from 0.05 to 2, preferably within the range from 1 to 1.5, mol equivalents.

The hydrolysis of the copolymerized units of the structure Ia can also be effected with the aid of bases, for example metal hydroxides, especially alkali metal or alkaline earth metal hydroxides. Preference is giving to using sodium hydroxide or potassium hydroxide. The hydrolysis can also be carried out in the presence of ammonia or amines.

The polymer solutions or dispersions thus obtainable are very useful as tanning materials in leather and fur production.

The present invention accordingly also provides a method of self-tanning, pretanning and cotanning leather pelts and fur pelts and for retanning leather and fur, which comprises using tanning materials comprising N-vinyl-containing polymers as described above in the form of aqueous solutions or dispersions.

The polymers used according to the invention can be used for cotanning leather pelts and fur pelts together with the tanning materials of the main tannage, which can be, for example, a chromium, aluminum, titanium or zirconium tannage. In this case, the operating conditions with regard to pH, temperature and duration of the treatment are adjusted to the requirements of the main components of the tannage; the same applies to the treatment apparatus and the liquor length and also to the aftertreatment. The amount required of copolymer used according to the invention is here normally within the range from 0.1 to 20% by weight, especially within the range from 0.5 to 15% by weight, based on the pelt weight.

More particularly, the polymers used according to the invention are useful for retanning already tanned leather and fur, for example wet blue, wet white (leather pelts or fur pelts pretanned with, for example, aldehydes or synthetic tanning materials) or vegetable-tanned leather or fur, in an aqueous liquor. Preference is given to retanning chrome leather. Here the procedure is generally such that the pickled leather pelts and fur pelts, for example cattlehide pelts from 1.5 to 4 mm in split thickness, are tanned in a conventional manner with, for example, a chrome tanning material such as a chromium(III) salt, e.g., chromium(III) sulfate, the resulting pretanned hides are neutralized and treated with an aqueous solution of the polymers used according to the invention at a pH of from 2 to 7, especially from 3.5 to 6, and at a temperature of from 15 to 60° C., especially from 25 to 45° C., for a period within the range from 0.25 to 12 hours. This treatment is effected, for example, by drumming. The required amount of polymer used according to the invention, reckoned as 100% active substance, is normally, based on the shaved weight of the leather, within the range from 0.2 to 10% by weight, especially within the range from 0.5 to 5% by weight. The liquor length is customarily within the range from 30 to 200% in the case of leather pelts and within the range from 100 to 2,000% in the case of fur pelts, in each case based on the shaved weight of the leather.

After, and if necessary also before, the treatment the leather or fur is customarily adjusted to a pH within the range from 3 to 5, using, for example, an organic acid such as formic acid or its salts, salts of carbonic acid, or synthetic tanning materials having a neutralizing effect, and is, if desired, dyed and fatliquored toward the end or after the treatment.

The leather or fur thus retanned can have been additionally treated with other tanning materials such as other polymeric tanning materials, synthetic or vegetable tanning materials prior to the retanning with the polymers used according to the invention. Similarly, the polymers used according to the invention can simultaneously be used with such additional tanning materials.

Useful additional or simultaneous tanning materials include all customary materials having a tanning effect on leather pelts and fur pelts. A comprehensive treatment of such tanning materials is found, for example, in Ullmanns Encyclopädie der technischen Chemie, 3rd edition, 11th volume, pages 585 to 612 (1960). Specific classes of tanning materials are the mineral tanning materials, e.g., chromium, aluminum, titanium and zirconium salts, the synthetic tanning materials, the vegetable tanning materials and the polymeric tanning materials.

Self-tanning and pretanning with the polymers used according to the invention is likewise possible, but of lesser interest.

The leathers produced using the polymers used according to the invention have excellent properties with regard to lightfastness and heat stability. This is particularly noticeable on chrome-pretanned leather. In addition, the polymers used according to the invention need only be used in small amounts to provide very good fullness and good fineness and tightness of grain.

Surprisingly, the polymers used according to the invention do not have the dyeing disadvantages of polymers based on acrylic and methacrylic acid. They produce leathers having a very deep as well as very uniform and level color.

One particular advantage of the polymers used according to the invention is that it is impossible for them, in contradistinction to conventional syntans, to contain any unsafe unsulfonated phenols as residual monomers.

The Examples hereinbelow illustrate the present invention. The percentages are by weight, unless otherwise stated.

EXAMPLES

1. Preparation of Polymers

Example 1

A 2 l glass reactor equipped with anchor stirrer, two automatic feed stream metering means and oilbath heating was charged with 880 g of water, 98 g of maleic anhydride, 80 g of sodium hydroxide and 2.3 g of sodium dihydrogenphosphate as initial charge. The pH of the solution was 6.5. The temperature was then raised to 80° C. in a slow stream of nitrogen and the pressure reduced to about 470 mbar to produce gentle boiling. A mixture of 71 g of N-vinylformamide and 2.5 g of mercaptoethanol (feed stream 1) was metered in over 4 hours, while at the same time 7.5 g of 2,2'-azobis(2-amidinopropane) dihydrochloride, dissolved in 100 g of water (feed stream 2), were metered in over 6 hours. On completion of the addition the batch was allowed to polymerize to completion for a further hour. Throughout the entire reaction time the condensate (a total of 375 g) was distilled off. The resulting solution had a solids content of 34.0%. The K value of the polymer, as measured in 1% strength concentration in water, was 48.7.

The polymer solution was then heated to 80° C. in the same glass reactor and 80 g of 50% strength sodium hydroxide solution were added dropwise in the course of an hour. The batch was subsequently stirred at that temperature for 2 hours, cooled down and adjusted to pH 7.0 with concentrated hydrochloric acid. The degree of hydrolysis of the polymer was 100%.

Example 2

A 2 l glass reactor equipped with anchor stirrer, three automatic feed stream metering means, reflux condenser and oilbath heating was charged with 539.5 g of water, 0.66 g of 85% strength phosphoric acid and 0.51 g of 50% strength sodium hydroxide solution as initial charge. The pH of the solution was 6.5. The temperature was then raised to 85° C. in a slow stream of nitrogen. On attainment of the desired temperature a solution of 79.2 g of acrylic acid, 88.0 g of 50% strength sodium hydroxide solution and 100 g of water (feed stream 1) was metered in over 2 hours, while at the same time 51.8 g of N-vinylformamide (feed stream 2) were metered in. Half a solution of 3.25 g of 2,2'-azobis(2-amidinopropane)dihydrochloride in 100 g of $H_2O$ (feed stream 3) was likewise metered in over two hours, before the rest of feed stream 3 was metered in over a further hour. On completion of the addition the aqueous solution copolymer was allowed to polymerize out for two hours at a constant 85° C. The solution had a solids content of 17%. The K value of the polymer, measured as a 1% strength concentration in 5% strength NaCl solution, was 46.8.

Example 3

454 g of the aqueous copolymer solution of Example 2 were placed in a 1 l glass flask equipped with anchor stirrer, reflux condenser and dropping funnel and heated to 80° C. with stirring. 27.6 g of 50% strength sodium hydroxide solution were metered in over 10 minutes, and the batch was stirred at 80° C. for three hours. It was then cooled down and adjusted to pH 7 with 36.6 g of concentrated hydrochloric acid. The degree of hydrolysis of the polymer was 79%. The active substance content of the solution was 12.4%.

Example 4

A 2 l glass reactor equipped with anchor stirrer, four automatic feed stream metering means, reflux condenser and oilbath heating was charged with 600 g of toluene as initial charge, which was heated to reflux (110° C.) under an inert gas. 24 g of styrene (feed stream 1) were then metered in at a uniform rate over an hour. 71 g of N-vinylformamide (feed stream 2) and 49 g of maleic anhydride, dissolved in 100 g of toluene (feed stream 3), were added at a uniform rate over 4 hours. Feed stream 4, 5 g of 1,1'-azobis(cyclohexane-1-carbonitrile), dissolved in 45 g of toluene, was added over 5 hours. Following a postpolymerization time of 2 hours, the precipitated polymer was filtered off, washed with acetone and dried. The yield of polymer was 144 g. The K value, measured on a 1% strength concentration in water, was 35.5.

130 g of the terpolymer obtained were then dissolved in 520 g of water and hydrolyzed with 152 g of 50% strength sodium hydroxide solution at 80° C. for 6 hours. The pH was then adjusted to 7 using concentrated hydrochloric acid. The degree of hydrolysis of the polymer was 80%.

2. Application Examples

Example A

Retanning of Chrome Leather to Form Shoe-upper Leather

A cattlehide wet blue 1.5 mm in shaved thickness was conventionally rinsed, washed and then neutralized with sodium formate and sodium bicarbonate at 30° C. to a pH of 4.5. The wash was followed by drumming at 35° C. for 30 minutes in 100% liquor with 1% of the hydrolyzed copolymer of Example 1, based on the solids content, and then admixture with 4% of a commercially available synthetic tanning material based on a phenolsulfonic acid/formaldehyde condensate and further drumming for 90 minutes. Thereafter the leather was washed again and dyed with 1% of a commercially available dye for 20 minutes at 50° C. in 100% liquor. This was followed in the same liquor by fatliquoring with 5% of a commercially available fat liquor. Thereafter the leather was acidified with formic acid to pH 3.5. Following a brief rinse, the leather was set out, dried, conditioned and staked. The leather obtained combined very good fullness with an elastic hand and a tight grain. The dyeing with anionic dyes was significantly deeper, brighter and more level than for comparable commercial products based on acrylic acid, methacrylic acid or maleic acid.

The unhydrolyzed or partially hydrolyzed copolymers of Examples 2 to 4 were used in a similar manner to Example A, and the properties varied in respect of fullness, depth of shade and fineness of grain with the composition of the product. The leathers had a tight grain in every case, especially in the flanks and belly. The dyeings were superior to commercially available polymers in depth of shade and levelness.

Example B

Retanning of Chrome Leather Combined with Vegetable Tanning Materials to Form Shoe-upper Leather A cattle hide wet blue 1.5 mm in shaved thickness was washed and neutralized similarly to Example A. The leather was then treated in 100% liquor with 1%, based on the active substance content, of the hydrolyzed copolymer of Example 1 at 40° C. over 30 minutes. Subsequently 5% of a commercially available vegetable tanning material (mimosa) and 2% of commercially available resin tanning material were added to the same liquor and the leather was drummed for 90 minutes. The liquor was adjusted to pH 4.2 with formic acid and drumming was continued for a further 20 minutes. The leather was then washed, dyed, fatliquored and acidified similarly to Example A. The leather obtained was firm and had excellent fullness and tightness, especially suitable for the firmer type of shoe. The dyeing was very bright, level and deep despite the use of the vegetable tanning material.

The copolymers of Examples 2 to 4 were used in a similar manner to Example B, and again the properties in respect of fullness, depth of shade and levelness were superior to the commercially available polymers. Example B shows an excellent compatibility of the polymers of the invention with the synthetic or vegetable tanning materials customarily used in leathermaking.

We claim:

1. A method, comprising:

self-tanning, pretanning and cotanning leather pelts and fur pelts and retanning leather by applying N-vinyl-containing polymers prepared by free-radically initiated polymerization of a monomer or monomer mixture of (A) from 5 to 100% by weight of an N-vinylamide of formula I:

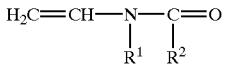

(I)

and/or of an N-vinylamine of formula II

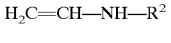

(II)

where $R^1$ and $R^2$ are independently hydrogen or $C_1$–$C_6$-alkyl, (B) from 5 to 95% by weight of monoethylenically unsaturated carboxylic acids having from 3 to 8 carbon atoms, their alkali metal, alkaline earth metal or ammonium salts, anhydrides, esters, amides and/or nitriles, (C) from 0 to 95% by weight of other N-vinyl and/or C-vinyl compounds selected from the group consisting of N-vinylpyrrolidone, N-vinylcaprolactam, N-vinylimidazole, N-vinyl-2-methylimidazole, N-vinyl-4-methylimidazole, N,N-diallylammonium chloride, vinyl acetate, vinyl propionate, styrene and methylstyrenes, and (D) from 0.1 to less than 10% by weight of other copolymerizable monomers selected from the group consisting of acrylamidoglycolic acid, vinylsulfonic acid, allylsulfonic acid, methallylsulfonic acid, styrenesulfonic acid, 3-sulfopropyl acrylate, 3-sulfopropyl methacrylate, acrylamidomethylpropanesulfonic acid, vinylphosphonic acid, allylphosphonic acid and acrylamidomethanepropanephosphonic acid, wherein the proportions of said monomers (A) to (D) add up to 100% by weight of the product of the polymerization reaction and the N-acyl groups derived from said N-vinylamides I are partially or completely removable from the resulting polymers by hydrolytic detachment using acids or bases, in the form of aqueous solutions or dispersions to said leather pelts, fur pelts, leather or fur.

2. The method as claimed in claim 1, wherefor said N-vinyl-containing polymers are obtainable by free-radically initiated polymerization of a monomer mixture of from 10 to 70% by weight of monomer (A), from 10 to 90% by weight of monomer (B), from 0 to 50% by weight of monomer (C), and from 0 to 5% by weight of monomer (D).

3. The method as claimed in claim 1, wherefor said N-vinyl-containing polymers are obtainable by free-radically initiated polymerization of acrylic acid, methacrylic acid, maleic acid, maleic anhydride or mixtures thereof as monomer (B).

4. The method as claimed in claim 1, wherefor said N-vinyl-containing polymers have Fikentscher values ranging from 7 to 250.

5. The method as claimed in claim 1, wherein a monomer of formula (I) is N-vinylformamide, N-vinyl-N-methylformamide, N-vinylacetamide, N-vinyl-N-methylacetamide, N-vinyl-N-ethylacetamide, N-vinylpropionamide, N-vinyl-N-methylpropionamide or N-vinylbutyramide.

6. The method as claimed in claim 1, wherein said monomer (B) is a $C_{3-8}$-monoethylenically unsaturated carboxylic acid or an ester, amide or nitrile thereof.

7. The method of claim 6, wherein said monomer (B) is methyl acrylate, ethyl acrylate, methyl methacrylate, ethyl methacrylate, hydroxyethyl acrylate, hydroxypropyl acrylate, hydroxybutyl acrylate, hydroxyethyl methacrylate, hydroxypropyl methacrylate, hydroxyisobutyl acrylate, hydroxyisobutyl methacrylate, methyl hydrogen maleate, dimethyl maleate, ethyl hydrogen maleate, diethyl maleate, 2-ethylhexyl maleate, 2-ethylhexyl methacrylate, acrylamide, methacrylamide, N-dimethacrylamide, N-tert-butylacrylamide, acrylonitrile, methacrylonitrile, dimethylaminoethyl acrylate, diethylaminoethyl acrylate or diethylaminoethyl methacrylate.

8. The method of claim 6, wherein said monomer (B) is acrylic acid, methacrylic acid, dimethacrylic acid, ethacrylic acid, maleic acid, citraconic acid, methylenemalopnic acid, allylacetic acid, vinylacetic acid, crotonic acid, fumaric acid, mesaconic acid or itaconic acid.

9. The method of claim 4, wherein said Fikentscher value is 20 to 100.

10. The method as claimed in claim 1, wherein said N-vinylamide is hydrolyzed by treatment with a hydrogen halide in gas or aqueous solution form.

* * * * *

UNITED STATES PATENT AND TRADEMARK OFFICE

CERTIFICATE OF CORRECTION

PATENT NO. : 6,652,597 B1
DATED : November 25, 2003
INVENTOR(S) : Negele et al.

It is certified that error appears in the above-identified patent and that said Letters Patent is hereby corrected as shown below:

Title page,
Item [30], Foreign Application Priority Data, should read:

-- [30] Foreign Application Priority Data
Apr. 9, 1998 (DE) .....19815946 --

Signed and Sealed this

Seventeenth Day of February, 2004

JON W. DUDAS
*Acting Director of the United States Patent and Trademark Office*